US006286191B2

(12) United States Patent
Van Erden

(10) Patent No.: US 6,286,191 B2
(45) Date of Patent: Sep. 11, 2001

(54) SLIDE-ZIPPER ASSEMBLY, METHOD OF ATTACHING SLIDE-ZIPPER ASSEMBLY TO THERMOPLASTIC FILM, AND METHOD OF MAKING SLIDE-ZIPPERED PACKAGES

(75) Inventor: Donald L. Van Erden, Wildwood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/757,264

(22) Filed: Jan. 9, 2001

Related U.S. Application Data

(62) Division of application No. 09/361,087, filed on Jul. 26, 1999, now Pat. No. 6,212,857.

(51) Int. Cl.[7] ..... A44B 19/16; B65D 33/00

(52) U.S. Cl. ..... 24/399; 24/400; 24/587; 24/576

(58) Field of Search ..... 24/399, 400, 587, 24/576; 383/63

(56) References Cited

U.S. PATENT DOCUMENTS

| | | | | |
|---|---|---|---|---|
| 3,991,801 | | 11/1976 | Ausnit . | |
| 4,285,376 | | 8/1981 | Ausnit . | |
| 4,655,862 | * | 4/1987 | Christoff et al. | 383/63 |
| 4,682,366 | | 7/1987 | Ausnit et al. . | |
| 4,894,975 | | 1/1990 | Ausnit . | |
| 4,909,017 | * | 3/1990 | McMahon et al. | 383/63 |
| 5,131,121 | * | 7/1992 | Herrington, Jr. et al. | 24/400 |
| 5,664,299 | * | 9/1997 | Porchia et al. | 24/400 |
| 5,669,715 | | 9/1997 | Dobreski et al. . | |
| 5,713,669 | | 2/1998 | Thomas et al. . | |
| 6,047,450 | * | 4/2000 | Machacek et al. | 24/399 |
| 6,115,892 | * | 9/2000 | Malin et al. | 24/587 |

* cited by examiner

*Primary Examiner*—Victor N. Sakran
(74) *Attorney, Agent, or Firm*—Pitney, Hardin, Kipp & Szuch LLP

(57) ABSTRACT

A slide-zipper assembly, a method of attaching the slide-zipper assembly to thermoplastic film, and a method of making slide-zippered packages are provided. According to the first aspect of the present invention, the slide-zipper assembly is comprised of a reclosable zipper and an optional slider. The reclosable zipper includes a first profile interlockable with a second profile. Each profile includes an interlocking member and a flange extending from the interlocking member on one side thereof at the bottom of the zipper. The interlocking members are interlockable with one another. The zipper flanges are wrapped around the zipper and joined together at the top of the zipper. The slider straddles the zipper and is adapted to open the zipper as it is moved therealong in an opening direction and to close the zipper as it is moved therealong in a closing direction. According to the second aspect of the present invention, lengths of the reclosable zipper are attached to thermoplastic film via the connected flanges. The zipper-equipped thermoplastic film may then be fed into an FFS machine or the like or rolled up for later use. According to the third aspect of the present invention, the reclosable zipper-equipped thermoplastic film is fed into an FFS machine or the like where it is made into reclosable packages.

3 Claims, 6 Drawing Sheets

SLIDE-ZIPPER ASSEMBLY, METHOD OF ATTACHING SLIDE-ZIPPER ASSEMBLY TO THERMOPLASTIC FILM, AND METHOD OF MAKING SLIDE-ZIPPERED PACKAGES

CROSS REFERENCE TO RELATED APPLICATIONS. This is a division of U.S. Pat. application Ser. No. 09/361,087 filed on Jul. 26, 1999. Now Pat. No. 6,212,857.

BACKGROUND OF THE INVENTION

1. Field of the Invention

The present invention relates to the field of reclosable packaging. More particularly, the present invention relates to a slide-zipper assembly; a method of attaching the slide zipper assembly to thermoplastic film; and a method of making slide-zippered packages, preferably on a form-fill-seal (FFS) machine.

2. Description of the Prior Art

Slide-zipper assemblies are well-known in the reclosable packaging art, such as those slide-zipper assemblies disclosed in U.S. Pat. Nos. 5,007,143, 5,008,971, 5,131,121 and 5,664,299. Methods of making reclosable packages on FFS machines are likewise well-known in the reclosable packaging art, such as those methods disclosed in U.S. Pat. Nos. 4,909,017, 4,655,862 and 4,894,975.

Because of the facility which is provided by slide-zippers to consumers of reclosable packages and because of the large volume of reclosable packages made on FFS machines today, it is highly desirable and advantageous to combine the two technologies so that slide-zippered packages can be made on FFS machines.

SUMMARY OF THE INVENTION

Accordingly, an object of the present invention is to provide a new type of slide-zipper assembly particularly suited for use in the manufacture of slide-zippered packages on FFS machines. Another object of the present invention is to provide a method of attaching the slider zipper assembly to thermoplastic film, which thermoplastic film can subsequently be used to make slide-zippered packages on an FFS machine or the like. Yet another object of the present invention is to provide a method of making slide-zippered packages, preferably on an FFS machine.

According to a first aspect of the present invention, a reclosable zipper is provided. The reclosable zipper is comprised of a first profile interlockable with a second profile. Each profile includes an interlocking member and a flange extending from the interlocking member on one side thereof at the bottom of the zipper. The interlocking members are interlockable with one another. The zipper flanges are wrapped around the zipper and joined together at the top of the zipper. Optionally, a slider may be included for opening and closing the zipper. The slider straddles the zipper and is adapted to open the zipper as it is moved therealong in an opening direction and to close the zipper as it is moved therealong in a closing direction.

According to a second aspect of the present invention, lengths of the reclosable zipper are attached to thermoplastic film via the connected flanges. The zipper-equipped thermoplastic film may then be fed into an FFS machine or rolled up for later use.

According to a third aspect of the present invention, the zipper-equipped thermoplastic film is fed into an FFS machine or the like where it is made into reclosable packages.

The present invention will now be described in detail, with frequent reference being made to the drawings identified below in which the same numerals represent the same elements.

DETAILED DESCRIPTION OF THE PREFERRED EMBODIMENT

Figure 1A:
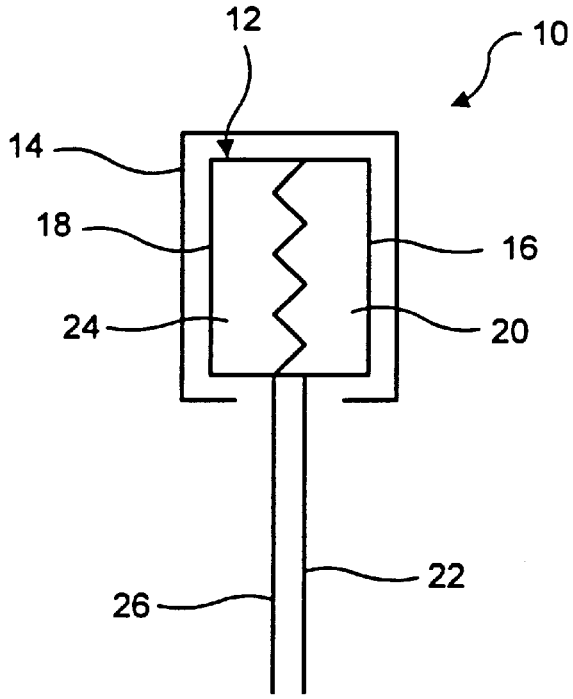
FIGS. 1(*a*) and 1(*b*) are cross-sectional views of a length slide-zipper assembly in accordance with the present invention.
Figure 1B:
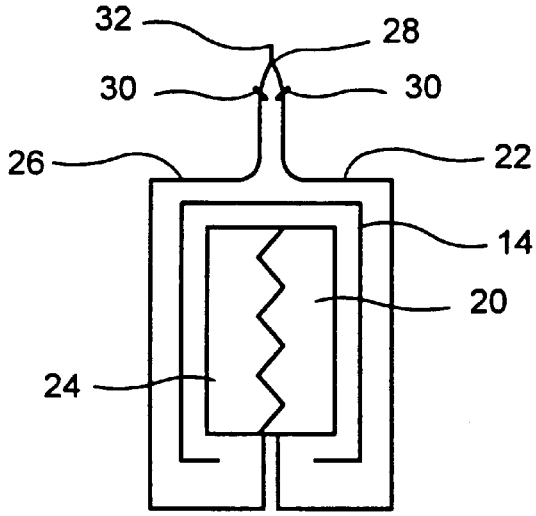

In accordance with the first aspect of the present invention, a cross-sectional view of a length of slide-zipper assembly 10 is shown in FIGS. 1 (*a*) and 1 (*b*). The slide-zipper assembly 10 includes a reclosable zipper 12 and a straddling slider 14. The slider 14 is adapted to open the zipper 12 as it is moved therealong in an opening direction and to close the zipper 12 as it is moved therealong in a closing direction. Although the slider 14 is included in the preferred embodiment, the slider 14 is optional and is not necessary to practice the present invention.

The zipper 12 includes a first profile 16 and a second profile 18. The first profile 16 includes an interlocking member 20 and a flange 22 extending from the interlocking member 20 on one side thereof at the bottom of the slide-zipper assembly 10. Similarly, the second profile 18 includes an interlocking member 24 and a flange 26 extending from the interlocking member 24 on one side thereof. The interlocking members 20, 24 are interlockable with each other and are designed to cooperate with the slider 14 so that they may be readily engaged and disengaged as the slider 14 is moved along the zipper 12 in the closing and opening directions, respectively. The interlocking members 20, 24 may have any shape which permits their releasable engagement.

Preferably, the zipper flanges 22, 26 are coextruded with their corresponding interlocking members 20, 24, but may be extruded separately and attached later, such as by welding or by an adhesive. The zipper 12 and slider 14 are each made of a resilient plastic.

As shown in FIG. 1 (*b*), the zipper flanges 22, 26 are of a sufficient length that they can be wrapped around the interlocking members 20, 24 and the slider 14 and connected together at a connection point 28 at the top of the zipper. The flanges 22, 26 may be welded together or connected through use of an adhesive at the connection point 28. Additionally, a perforation 30 is provided on each flange between the connection point 28 and the interlocking members 20, 24. These perforations facilitate the use of the slide-zipper assembly 10 in reclosable packages, as discussed in detail below.

Figure 2:
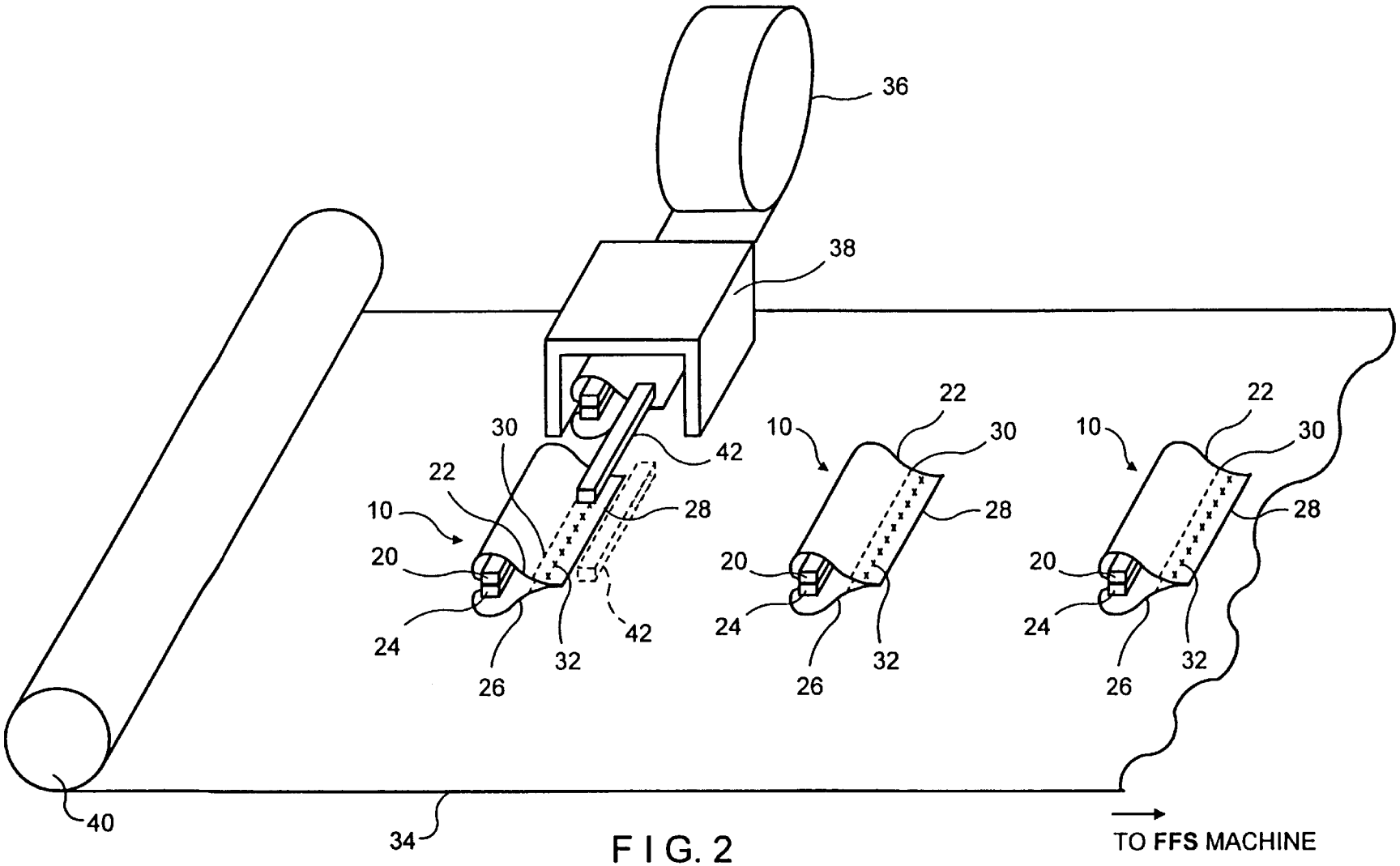
FIG. 2 is a perspective view of slide-zipper assembly lengths being attached transversely to thermoplastic film.
Figure 3:
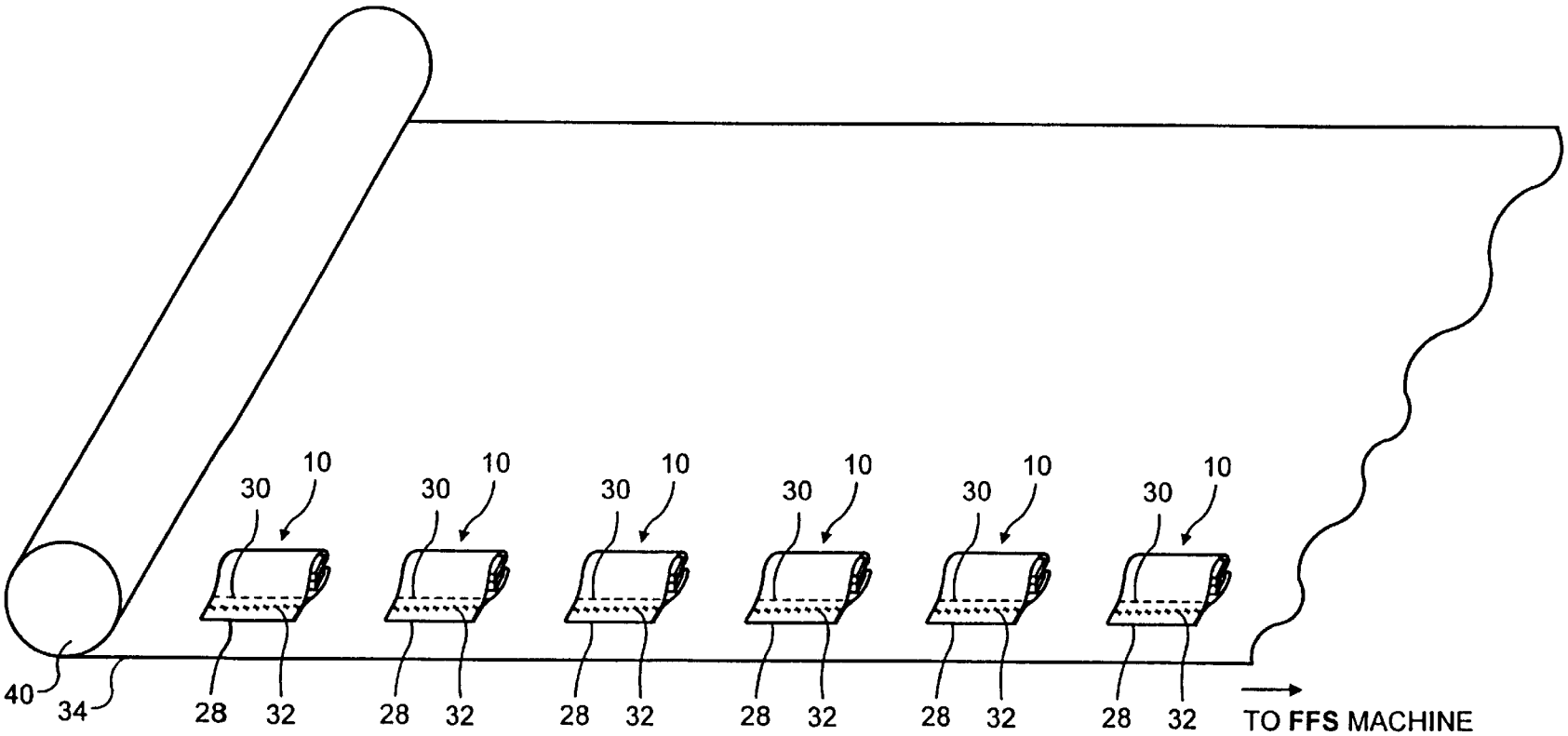
FIG. 3 is a perspective view of slide-zipper assembly lengths attached longitudinally to thermoplastic film.

In accordance with the second aspect of the present invention, lengths of slide-zipper assembly 10 are attached to thermoplastic film 34 which may be used to make reclosable packages on an FFS machine. The slide-zipper assembly lengths 10 may be attached to the thermoplastic film 34 transversely to the running direction, as shown in FIG. 2, or parallel to the running direction, as shown in FIG. 3. The former method is commonly known as the "transverse zipper" method, while the latter method is commonly known as the "longitudinal zipper" method.

With respect to the transverse zipper method illustrated in FIG. 2, the slide-zipper assembly lengths 10 are attached to the thermoplastic film 34 via the ends 32 of the connected flanges 22, 26. The slide-zipper assembly lengths 10 may either be pre-cut to the required length or, as shown in FIG. 2, may be supplied from a supply roll 36.

As shown in FIG. 2, the slide-zipper assembly 10 is pulled across the thermoplastic film 34 by a positioning device 38, which positions the slide-zipper assembly lengths 10 on the thermoplastic film 34 and cuts them from the continuous roll 36. The positioning device 38 can take any of a variety of forms well-known to those skilled in the reclosable packaging art, such as a vacuum conveyor for pulling the slide-zipper assembly across the thermoplastic film 34 and a knife for cutting the slide-zipper assembly lengths 10 from the continuous roll thereof 36.

The thermoplastic film 34 is paid off a continuous roll 40 in increments equal to the length of the packages which will ultimately be formed from the film 34 in an FFS machine. Each time the film 34 comes to rest locally, a slide-zipper assembly length 10 is disposed on the thermoplastic film 34 transverse to the running direction with the ends 32 of the connected zipper flanges 22, 26 projecting in the running direction and with one of the interlocking members above the other relative to the thermoplastic film 34. The flanges so oriented allow the slide-zipper assembly 10 to pass freely over the forming collar of an FFS machine. As disclosed in U.S. Pat. No. 4,909,017, the slide-zipper assembly lengths 10 have a length approximately equal to half the width of the film 34 and are disposed centrally thereon. However, the slide-zipper assembly lengths 10 may also be positioned at different locations on the film, such as adjacent an edge of the film. Seal bars 42 are positioned to seal the zipper flanges to the thermoplastic film 34 between the perforations 30 and the connection point 28. The seal, which is denoted by a series of x's, may be a tack seal or a full seal.

For proper functioning, the zipper interlocking members 20, 24 should be spot sealed together at the ends of the slide-zipper assembly lengths 10. This ensures that the zipper halves will not come apart during use and also provides end stops for the slider 14. If the slide-zipper assembly lengths 10 are pre-cut, this sealing can take place during the cutting process, or even earlier. If the lengths are supplied from a continuous roll, then the positioning device can be adapted to make these spot seals. However, only the interlocking members 20, 24 should be spot sealed together. The zipper flanges 22, 26 should not be sealed together at the ends of the slide-zipper length 10. This will allow the slide-zipper to be extended from the package when the package is opened for the first time.

Once the slide-zipper assembly lengths 10 are attached to the thermoplastic film 34, the film may be rolled up for later use, or may be fed into an FFS machine or the like and formed into packages.

Alternatively, as shown in FIG. 3, the slide-zipper assembly lengths 10 may be attached to the film along an edge thereof parallel to the running direction, the so-called longitudinal zipper method. In that case the ends 32 of the zipper flanges 22, 26 are attached to the thermoplastic film 34 adjacent an edge. As with the transverse zipper method, the slide-zipper assembly lengths 10 may be pre-cut or supplied from a continuous roll. In the latter case, the supply roll 36 and positioning device 38 shown in FIG. 2 are positioned inline with the thermoplastic film 34.

In the third aspect of the present invention, the thermoplastic film 34 with slide-zipper assembly lengths 10 attached thereto is fed into an FFS machine 44 or the like. Methods of making reclosable packages on FFS machines using transverse and longitudinal zippers are well-known and are disclosed in U.S. Pat. Nos. 4,909,017, 4,655,862 and 4,894,975, the disclosures of which are incorporated herein by reference.

Figure 4:
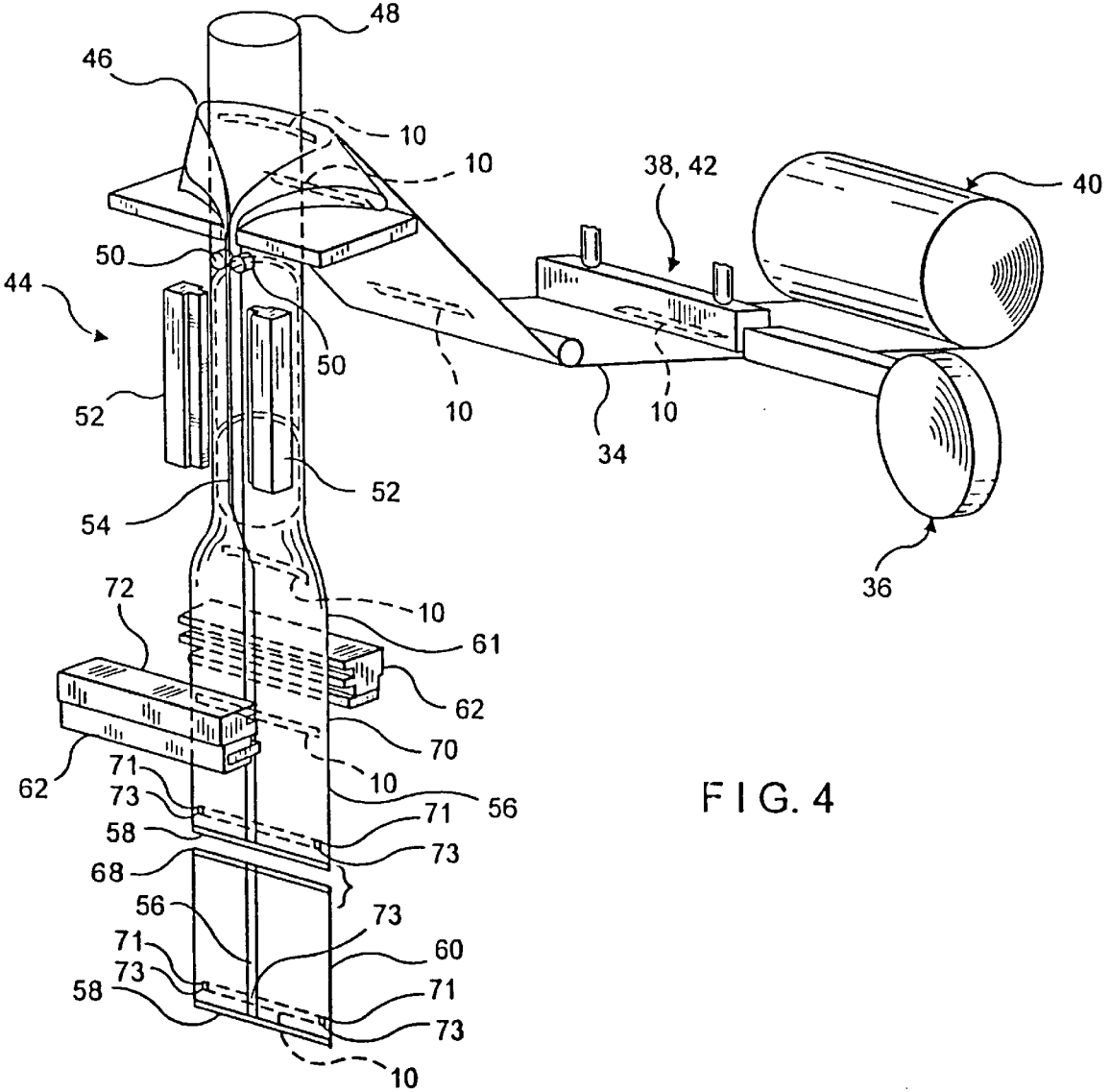
FIG. 4 is a perspective view of slide-zippered packages being made on an FFS machine.

FIG. 4 shows an FFS machine 44 configured to make transverse slide-zippered packages. As shown in FIG. 4, the thermoplastic film 34 is fed downwardly over the collar 46 and folded around filling tube 48. The edges of the film are brought together and pressed together by a pair of rollers 50. The edges are then welded together by a pair of longitudinal seal bars 52 to form a longitudinal back seal 54. Contents may then dropped through the tube 48 into the package which is presently being formed 56, which has a lower seal 58 which was formed when the immediately preceding package 60 was completed.

After introduction of the contents, the top (which will actually be the bottom of the package during use) of the instant package 56 and the bottom (which will actually be the top of the package during use) of the succeeding package 61 are completed by the action of the cross seal jaws 62, which perform six simultaneous or nearly simultaneous functions.

With respect to the bottom of the succeeding bag 61, the cross seal jaws 62 seal the portions of the zipper flanges 22, 26 between the perforations 30 and the interlocking members 20, 24 to the front and back walls 64, 66 of the bag 61 without sealing the flanges to each other. The flanges may be coated with a heat activated adhesive to prevent the flanges from sealing to each other. Second, the cross seal jaws 62 seal the bottom of the bag 61 to form a pilfer evident lower seal 58. The connected zipper flanges 22, 26 extend into the pilfer evident seal. Third, the sides 70, 72 of the package 61 are spot sealed 71 and notched 73 in-line with the perforations 30 on the zipper flanges 22, 26. The longitudinal back seal may also be notched in-line with the perforations 30 as well.

With respect to the instant bag 56, the cross seal jaws 62 then make the top seal 68 and cut the bag 56 from the thermoplastic film 34. As shown in FIG. 4, the completed package 60 has a top seal 68, a transverse slide-zipper assembly length 10, a pilfer evident lower seal 58, a longitudinal back seal 54 and two spot seals 71 and three notches 73 in -line with the perforations 30 on the zipper flanges 22, 26.

Figure 5:
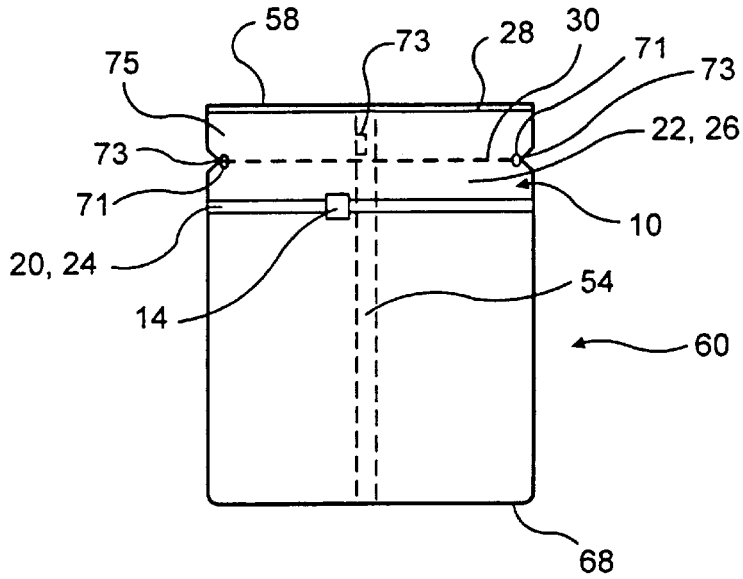
FIG. 5 is a front view of a package made on the FFS machine of FIG. 4.
Figure 6A:
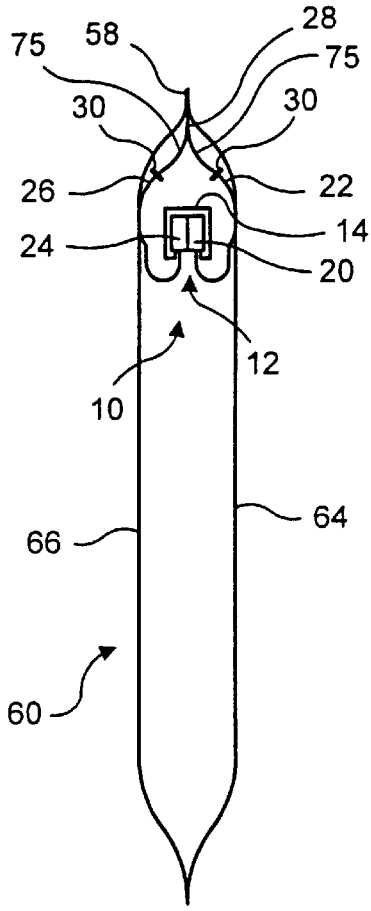
FIGS. 6(*a*), 6(*b*) and 6(*c*) are cross-sectional views of the package of FIG. 5 as it is being opened.
Figure 6B:
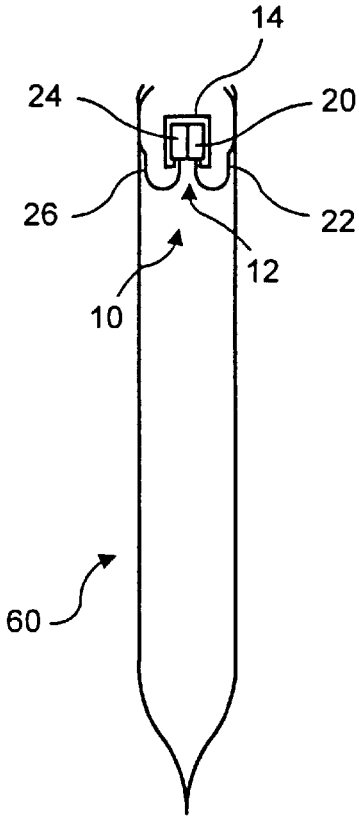
Figure 6C:
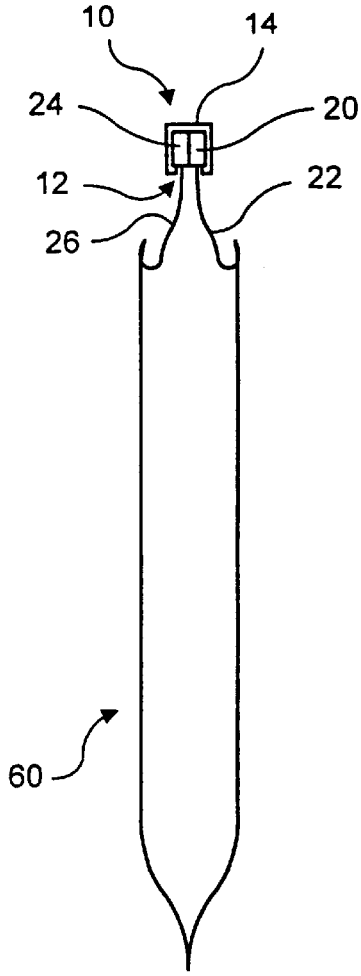

When the completed package 60 is used by the consumer, it is inverted so that the slide-zipper assembly 10 is at the top of the package 60, as shown in FIG. 5. To initially open the sealed package, the user tears off the top of the package, using one of the side notches 73 to start the tear. Because the spot seals 71 and notches 73 are in-line with the zipper perforations and because the connected zipper flanges 22, 26 extend into the pilfer evident top seal 58, the portions 75 of the zipper flanges 22, 26 between the perforations 30 and the connection point 28 are tom off as well. To gain access to the interior of the package, the user extracts the slide-zipper assembly 10 up and out of the package. The user then simply moves the slider 14 along the zipper 12 in the opening direction to gain access to the interior of the package 60. If a slider is not present, it is unnecessary to extract the zipper 10 out of the package. This accessing and opening process is illustrated in FIGS. 6(*a*)–6(*c*).

In the case where a longitudinal zipper is used, the FFS machine of FIG. 4 is configured so that the longitudinal seal bars 52, and not the cross-seal jaws 62, seal the zipper flanges 22, 26 to the package walls and create the pilfer evident seal 58 and side notches 73 and spot seals 71. Additionally, the cross-seal jaws are rotated 90° in order to complete the package side seals. Accessing and opening of the completed package is accomplished in the same manner as discussed above.

Figure 7:
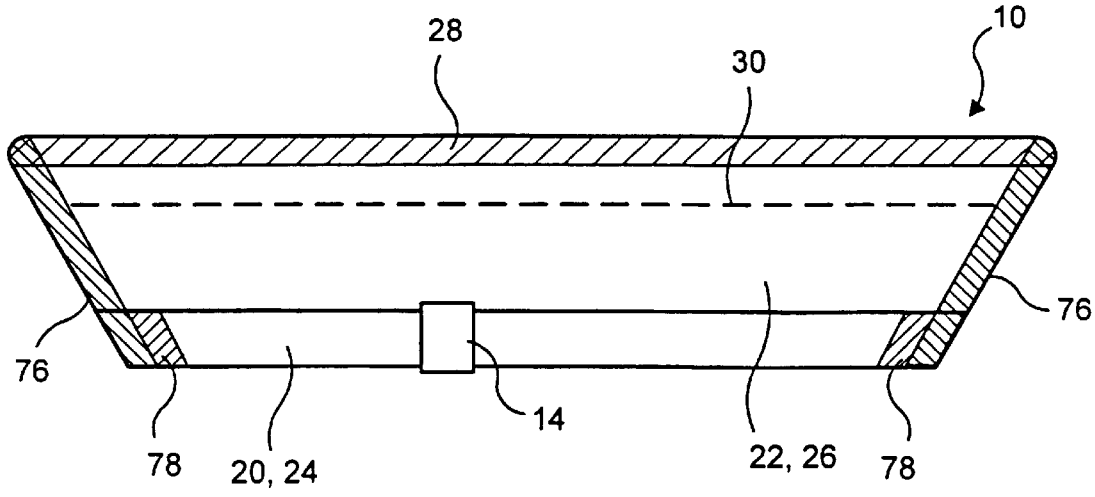
FIG. 7 is a plan view of a length of slide-zipper assembly in accordance with an alternate embodiment of the present invention.

To enhance extraction of the slide-zipper assembly from the completed package, the zipper flanges 22, 26 may be tapered and sealed together at the ends of the slide-zipper lengths 10, as shown in FIG. 7. These tapered seals 76 will make it easier for the user to pull the slide-zipper assembly from the inside of the package. These tapered seals can be made at the same time the interlocking members are spot sealed 78 together, either by the positioning device 38 or earlier if the slide-zipper assembly lengths 10 were pre-cut.

Thus, in the foregoing manner the object of the present invention is achieved. Modifications to the above would be obvious to those of ordinary skill in the art, but would not bring the invention so modified beyond the scope of the appended claims.

What is claimed is:

1. A reclosable zipper comprising:

a first profile and a second profile;

said first profile including an interlocking member and a flange extending from one side of said interlocking member at a bottom of said zipper;

said second profile including an interlocking member and a flange extending from one side of said interlocking member at said zipper bottom, said interlocking member being interlockable with said first profile interlocking member;

wherein said flanges are wrapped oppositely around said interlocking members and joined together at a top of said zipper.

2. The reclosable zipper according to claim 1 wherein each of said flanges is perforated along its length above said interlocking members.

3. The reclosable zipper according to claim 1 further comprising a slider disposed on said interlocking members, said slider being adapted to open said zipper as it is moved along said interlocking members in an opening direction and to close said zipper as it is moved along said interlocking members in a closing direction.

* * * * *